US008206828B2

(12) United States Patent
Ohta et al.

(10) Patent No.: US 8,206,828 B2
(45) Date of Patent: Jun. 26, 2012

(54) MATERIAL FOR FORMING ELECTROLESS PLATE AND METHOD FOR FORMING ELECTROLESS PLATE USING THE SAME

(75) Inventors: Tetsuji Ohta, Tokyo (JP); Mitsuhiro Watanabe, Yokosuka-shi (JP)

(73) Assignees: Kimoto Co., Ltd. (JP); Japan Surface Treatment Institute Co., Ltd. (JP)

( * ) Notice: Subject to any disclaimer, the term of this patent is extended or adjusted under 35 U.S.C. 154(b) by 934 days.

(21) Appl. No.: 12/224,722

(22) PCT Filed: Mar. 12, 2007

(86) PCT No.: PCT/JP2007/054848

§ 371 (c)(1),
(2), (4) Date: Sep. 4, 2008

(87) PCT Pub. No.: WO2007/108351

PCT Pub. Date: Sep. 27, 2007

(65) Prior Publication Data

US 2009/0075089 A1 Mar. 19, 2009

(30) Foreign Application Priority Data

Mar. 23, 2006 (JP) ..... 2006-080942

(51) Int. Cl.
*C25D 5/00* (2006.01)
*B32B 27/06* (2006.01)
*B32B 27/28* (2006.01)

(52) U.S. Cl. ..... 428/423.1; 106/287.23; 106/287.26; 205/159; 205/163; 428/355 N; 428/423.3

(58) Field of Classification Search ..... 428/413–522, 428/355 N; 106/287.23, 287.26; 205/159, 205/163

See application file for complete search history.

(56) References Cited

U.S. PATENT DOCUMENTS

| | | | | |
|---|---|---|---|---|
| 4,824,925 | A * | 4/1989 | Kamarchik et al. | 528/45 |
| 2003/0094296 | A1 * | 5/2003 | Kojima et al. | 174/35 MS |
| 2003/0132121 | A1 * | 7/2003 | Breen et al. | 205/231 |
| 2003/0138635 | A1 * | 7/2003 | Haruta et al. | 428/413 |
| 2004/0171867 | A1 * | 9/2004 | Okazaki | 560/183 |
| 2005/0042463 | A1 * | 2/2005 | Anderson et al. | 428/447 |
| 2005/0112388 | A1 * | 5/2005 | Watanabe et al. | 428/457 |
| 2006/0188656 | A1 * | 8/2006 | Katsuta et al. | 427/407.1 |

FOREIGN PATENT DOCUMENTS

| | | |
|---|---|---|
| JP | 61-035884 | 2/1986 |
| JP | 03-064481 | 3/1991 |
| JP | 07-261386 | 10/1995 |
| JP | 63-235384 | 9/1998 |
| JP | 2002-220677 | 8/2002 |
| JP | 2003-213437 | 7/2003 |
| JP | 2003-322957 | 11/2003 |

* cited by examiner

*Primary Examiner* — Lorna M Douyon
*Assistant Examiner* — Tri V Nguyen
(74) *Attorney, Agent, or Firm* — Bacon and Thomas, PLLC

(57) ABSTRACT

A material for electroless plating shows good adhesion for a catalyst and does not cause delamination of a catalyst adhering layer from a non-conductive base material in a catalyst adhering step, development step or other step.

In a material for electroless plating, having a catalyst adhering layer on a non-conductive base material, the catalyst adhering layer is formed from a hydrophilic and/or water-soluble resin containing hydroxyl group, and a curable layer formed from a resin having hydroxyl group and an isocyanate type compound is provided between the base material and the catalyst adhering layer. The catalyst adhering layer is preferably formed while isocyanate groups of the isocyanate type compound in the curable layer remain.

5 Claims, No Drawings

MATERIAL FOR FORMING ELECTROLESS PLATE AND METHOD FOR FORMING ELECTROLESS PLATE USING THE SAME

TECHNICAL FIELD

The present invention relates to a material for forming electroless plate formed by subjecting a non-conductive base material to a treatment enabling electroless plating.

BACKGROUND ART

Electroless plating is widely used as an industrial technique which can change non-conductive base material surfaces such as those of plastics, ceramics, paper, glass, and fibers into conductive surfaces. Especially when a surface of non-conductive base material is electrolytically plated, the non-conductive base material is electrolessly plated as a pretreatment for the electrolytic plating.

However, it is difficult to form electroless plate directly on a surface of non-conductive base material. This is because it is difficult to make a catalyst layer adhere to a base material surface as a pretreatment for electroless plating, since the base material surface of the non-conductive base material is smooth.

Therefore, surface of the non-conductive base material is conventionally roughened by a mechanical treatment or chemical treatment to enable a catalyst to adhere to the base material surface. However, if surface of the base material is roughened, the material as a whole becomes opaque, and therefore a problem arises that it comes to be unsuitable for use requiring transparency.

As means for solving this problem, there has been proposed a method of forming a gelatinous thin membrane containing a water-soluble polymer (catalyst adhering layer) on a non-conductive base material (Patent document 1).

Patent document 1: Japanese Patent Unexamined Publication (KOKAI) No. 2002-220677 (claims)

DISCLOSURE OF THE INVENTION

Object to be Achieved by the Invention

However, in the method of Patent document 1, although the gelatinous thin membrane adheres the catalyst, the gelatinous thin membrane may be delaminated from the non-conductive base material, when the gelatinous thin membrane is immersed in a catalyst bath in the catalyst adhering step or when a developer is brought into contact with the gelatinous thin membrane in the development step after the electrolytic plating.

As means for solving this problem, it is conceivable to use a means of curing the gelatinous thin membrane to improve durability of the gelatinous thin membrane to solvents used for the catalyst bath or developer. However, if the gelatinous thin membrane is cured, adhesion between the gelatinous thin membrane and the non-conductive base material is degraded, and the phenomenon of delamination of the gelatinous thin membrane from the non-conductive base material in the catalyst adhering step, development step and other steps cannot be sufficiently prevented.

The present invention was accomplished in view of the aforementioned technical situation, and an object of the present invention is to provide a material for forming electroless plate which shows good adhesion for a catalyst and does not cause delamination of a catalyst adhering layer from a non-conductive base material in a catalyst adhering step, development step and other steps.

Means for Achieving the Object

The material for forming electroless plate of the present invention, with which the aforementioned object is achieved, is a material for forming electroless plate comprising a non-conductive base material and a catalyst adhering layer provided on the non-conductive base material, wherein the catalyst adhering layer is formed from a hydrophilic and/or water-soluble resin containing hydroxyl group, and a curable layer formed from a resin having hydroxyl group and an isocyanate type compound is provided between the base material and the catalyst adhering layer.

In the material for forming electroless plate of the present invention, the catalyst adhering layer is preferably formed while isocyanate groups of the isocyanate type compound in the curable layer remain.

In the material for forming electroless plate of the present invention, the resin having hydroxyl group preferably has a hydroxyl value of 1 to 30 mg KOH/g.

In the material for forming electroless plate of the present invention, the catalyst adhering layer may contain a blocked isocyanate compound masked with a masking agent.

The method for forming an electroless plate of the present invention comprises making a catalyst adhere to the catalyst adhering layer of the material for forming electroless plate of the present invention, and then performing electroless plating.

The method for forming an electroless plate of the present invention may be a method for forming an electroless plate on a non-conductive base material comprising the step of forming a curable layer comprising a resin having hydroxyl group and an isocyanate type compound on a surface of the non-conductive base material, the step of forming a catalyst adhering layer comprising a hydrophilic and/or water-soluble resin containing hydroxyl group on the curable layer while isocyanate groups of the isocyanate type compound remain, and the step of adhering a catalyst to the catalyst adhering layer and then performing electroless plating.

Further, the method for forming an electroless plate of the present invention may also be a method of using the material for forming electroless plate of the present invention in which the catalyst adhering layer comprises a blocked isocyanate compound masked with a masking agent, and it comprises the step of adhering a catalyst to the catalyst adhering layer, the step of, after adhering the catalyst, dissociating the masking agent of the blocked isocyanate compound to promote curing, and the step of performing electroless plating, and characterized in that the method is performed under such a condition that the masking agent of the blocked isocyanate compound should not dissociate until the step of adhering the catalyst is finished.

Effect of the Invention

In the material for forming electroless plate of the present invention, the catalyst adhering layer is formed from a hydrophilic and/or water-soluble resin containing hydroxyl group, and a curable layer formed from a resin having hydroxyl group and an isocyanate type compound is provided between the non-conductive base material and the catalyst adhering layer. Therefore, the isocyanate type compound and the resin having hydroxyl group in the curable layer, and the isocyanate type compound in the curable layer and the hydrophilic and/or water-soluble resin containing hydroxyl group in the catalyst adhering layer can react to improve adhesion between the non-conductive base material and the catalyst adhering layer, and solvent resistance of the curable layer and the catalyst adhering layer. Delamination of the curable layer and the catalyst adhering layer from the non-conductive base material can be thereby prevented. Moreover, since such an effect can be obtained without unduly curing the catalyst adhering layer, the catalyst adhering performance of the catalyst adhering layer is not degraded.

Moreover, according to the method for forming electroless plate of the present invention, by using the material for forming electroless plate of the present invention, pretreatment for adhering catalyst can be omitted or can be performed in a short time, and the catalyst adhesion step such as sensitization treatment and activation treatment can be performed in a short time. Therefore, electroless plate can be easily formed on a non-conductive base material in a short time, and the curable layer or the catalyst adhering layer on the non-conductive base material does not delaminate during the operation of the method.

BEST MODE FOR CARRYING OUT THE INVENTION

The material for forming electroless plate of the present invention will be explained first. The material for forming electroless plate of the present invention is a material for forming electroless plate comprising a non-conductive base material and a catalyst adhering layer provided on the non-conductive base material, wherein the catalyst adhering layer is formed from a hydrophilic and/or water-soluble resin containing hydroxyl group, and a curable layer formed from a resin having hydroxyl group and an isocyanate type compound is provided between the base material and the catalyst adhering layer. Embodiments of the material for forming electroless plate of the present invention will be explained below.

Examples of the non-conductive base material include plastic films such as those of polyester, ABS (acrylonitrile/butadiene/styrene rubber), polystyrene, polycarbonate, acrylic resin, liquid crystal polymer (LCP), polyolefin, cellulose resin, polysulfone, polyphenylene sulfide, polyethersulfone, polyetheretherketone and polyimide, those made of ceramics, paper, glass, fibers, and so forth. When the non-conductive base material may be opaque, a base material having a roughened surface may also be used. If the surface of the base material is roughened, the surface of the catalyst adhering layer can be roughened by following the surface roughness of the base material, and adhesion of the catalyst can be thereby made easier.

The non-conductive base material is not limited to those having a flat shape, and it may have a three-dimensional shape.

On the non-conductive base material, a curable layer formed from a resin having hydroxyl group and an isocyanate type compound is provided.

The curable layer is located between the non-conductive base material and the catalyst adhering layer, and plays a role of improving adhesion between both layers, a role of preventing delamination of the curable layer itself and the catalyst adhering layer from the non-conductive base material by sufficient curing of the curable layer itself to improve solvent resistance thereof, and a role of curing the catalyst adhering layer to improve solvent resistance of the catalyst adhering layer.

Examples of the resin having hydroxyl group include polyester resins, polyvinyl butyral resins, polyvinyl acetal resins, acrylic resins and so forth, and resins not having hydroxyl group copolymerized with monomers having hydroxyl group or the like may also be used. These resins having hydroxyl group are preferably selected depending on the type of the non-conductive base material in order to improve adhesion to the non-conductive base material. Specifically, when the non-conductive base material consists of polyester, polypropylene (polyolefin), polyimide, polycarbonate or liquid crystal polymer, the resin having hydroxyl group is preferably a polyester resin. When the non-conductive base material consists of cellulose resin or polyphenylene sulfide, the resin having hydroxyl group is preferably a (meth)acrylic resin copolymerized with monomers having hydroxyl group.

The resin having hydroxyl group preferably has a hydroxyl value in the range of 1 to 30 mg KOH/g, although it depends on the reactivity between the isocyanate type compound and the resin constituting the catalyst adhering layer. By using such a resin having a hydroxyl value of 1 mg KOH/g or higher, the curable layer can be sufficiently cured to obtain favorable solvent resistance of the curable layer, and delamination of the curable layer and the catalyst adhering layer from the non-conductive base material can be thereby prevented. By using such a resin having a hydroxyl value of 30 mg KOH/g or lower, the isocyanate type compound can be prevented from reacting only in the curable layer so that formation of chemical bonds between the isocyanate type compound and the resin constituting the catalyst adhering layer can be kept from becoming hard, and thereby adhesion between the curable layer and the catalyst adhering layer can be made favorable.

Examples of the isocyanate type compound include 2,4-tolylene diisocyanate, 2,6-tolylene diisocyanate, m-phenylene diisocyanate, p-phenylene diisocyanate, 4,4'-diphenylmethane diisocyanate, tetramethylene diisocyanate, xylylene diisocyanate, lysine diisocyanate, trimethylhexamethylene diisocyanate, 1,4-cyclohexylene diisocyanate, 4,4'-dicyclohexylmethane diisocyanate, 3,3'-dimethyl-4,4'-biphenylene diisocyanate, 1,5-naphthalene diisocyanate, 1,5-tetrahydronaphthalene diisocyanate, derivatives thereof, and so forth.

Although amount of the isocyanate type compound cannot be generally defined, since it depends on the type of the resin having hydroxyl group, the molar ratio of hydroxyl groups of the resin having hydroxyl group and isocyanate groups of the isocyanate type compound is preferably in the range of 1:1 to 1:10. With a ratio of one or more of isocyanate groups to one of hydroxyl group, chemical bonds can be produced between the curable layer and the catalyst adhering layer, and adhesion between both can be made favorable. With a ratio of 10 or less of isocyanate groups to one of hydroxyl group, undue reaction of isocyanate groups with hydroxyl groups of the catalyst adhering layer or undue advance of self-crosslinking can be prevented. Thereby, degradation of adhesion (adhesion between the non-conductive base material and the curable layer and adhesion between the curable layer and the catalyst adhering layer) and degradation of catalyst adhering performance due to undue hardness and brittleness of the catalyst adhering layer and the curable layer as coated films can be prevented.

The curable layer preferably has a thickness of 0.1 to 2 μm. With a thickness of 0.1 μm or larger, adhesion between the non-conductive base material and the catalyst adhering layer can be made favorable. With a thickness of 2 μm or smaller, rigidity of the non-conductive base material is not degraded, and when the surface of the non-conductive base material is roughened, surface profile of the base material is easily reflected on the surface of the curable layer.

The catalyst adhering layer plays a role of adhering fine metal particles having a catalytic activity for electroless plating (catalyst), and is formed from a hydrophilic and/or water-soluble resin having hydroxyl group.

Since the resin forming the catalyst adhering layer has hydroxyl groups as described above, these hydroxyl groups and isocyanate groups of the isocyanate type compound in the curable layer chemically bond to improve adhesion between the catalyst adhering layer and the curable layer, and at the same time, the catalyst adhering layer can be cured to improve solvent resistance of the catalyst adhering layer. Further, by curing the catalyst adhering layer, the catalyst adhering layer can be made to hardly absorb moisture, and thereby insulation property thereof can be improved. Therefore, the material of the present invention can be preferably used for purposes requiring insulating property such as printed-wiring boards and antennas. Since curing of the catalyst adhering layer is attained by the reaction with the isocyanate type compound in the curable layer as a different layer, only a part of the catalyst adhering layer on the side closer to the curable layer can be cured, and thereby degradation of the catalyst adhesion performance can be prevented. On the other hand, if the isocyanate type compound is contained in the catalyst adhering layer and the catalyst adhering layer is cured only in this layer, the whole catalyst adhering layer is cured, and thus the catalyst adhering performance of the catalyst adhering layer is degraded.

In order to obtain the effect described above, the catalyst adhering layer is preferably formed on the curable layer while isocyanate groups of the isocyanate compound in the curable layer remain. Therefore, the catalyst adhering layer is preferably formed within 12 hours after the formation of the curable layer, although it greatly depends on storage conditions or type of the isocyanate. Further, in order to make isocyanate groups remain in the curable layer, the drying condition of the curable layer preferably consists of 80 to 120° C. for about 30 to 60 seconds.

Examples of the hydrophilic and/or water-soluble resin having hydroxyl group include natural resins such as albumin, gelatin, casein, starch, gum arabic and sodium alginate, and synthetic resins such as carboxymethylcellulose, hydroxyethylcellulose, methylcellulose, ethylcellulose, polyamide, polyacrylamide, polyphenylacetacetal, polyvinyl acetal, polyvinyl formal, polyurethane, polyvinyl alcohol, polyester, sodium poly(meth)acrylate and (meth)acrylic acid ester copolymer, and they can be independently used, or used as a combination of two or more kinds of these. Among these hydrophilic and/or water-soluble resins having hydroxyl groups, cellulose type resins such as carboxymethylcellulose, polyvinyl alcohol and polyvinyl acetal are preferably used in view of hydrophilicity and processability.

The catalyst adhering layer may contain a blocked isocyanate compound. Although the resin having hydroxyl group in the catalyst adhering layer can also be cured with the isocyanate type compound in the curable layer as a separate layer, use of curing reaction between compounds contained in the same layer makes design of films to be coated easier. Moreover, if a blocked isocyanate compound is used, by not dissociating the masking agent of the blocked isocyanate compound before adhesion of the catalyst, the catalyst adhesion performance of the catalyst adhering layer can be maintained, and the masking agent of the blocked isocyanate compound can be dissociated after adhesion of the catalyst to promote curing of the catalyst adhering layer and thereby improve solvent resistance and insulating property thereof.

The blocked isocyanate compound consists of the aforementioned isocyanate type compound masked with a masking agent. Any masking agents may be used without particular limitation, and examples include phenol, cresol, 2-hydroxypyridine, butyl cellosolve, propylene glycol monomethyl ether, ethylene glycol, ethanol, diethyl malonate, ethyl acetoacetate, acetylacetone, butyl mercaptan, acetanilide, acetic acid amide, succinimide, ϵ-caprolactam, imidazole, urea, acetaldoxime, diphenylamine, aniline, ethyleneimine, dimethylhydrazine, and so forth.

Dissociation temperature of the masking agent is preferably 100° C. or higher. If a masking agent showing a dissociation temperature of 100° C. or higher is used, dissociation of the masking agent is not caused before adhesion of the catalyst, and therefore workability can be improved. Moreover, the dissociation temperature of the masking agent is preferably lower than the softening point of the non-conductive base material.

The catalyst adhering layer preferably has a thickness of 0.1 to 3 μm. With a thickness of 0.1 μm or larger, adhesion of the catalyst becomes easy, and with a thickness of 3 μm or smaller, delamination of the catalyst adhering layer and degradation of insulating property due to invasion of developer from the sides of the material at the time of development can be prevented.

The curable layer and the catalyst adhering layer may contain additives including surfactants such as leveling agents and antifoams, anti-oxidants, chelating agents and other resins. However, the total amount of the resin having hydroxyl group and the isocyanate type compound is preferably 80% by weight or more, more preferably 90% by weight or more, based on all the components in the curable layer. Further, the hydrophilic and/or water-soluble resin having hydroxyl group preferably accounts for 80% by weight or more, more preferably 90% by weight or more, of all the components in the catalyst adhering layer.

The curable layer and the catalyst adhering layer can be formed by applying a coating solution dissolving materials constituting each layer such as the resins in an appropriate solvent on the non-conductive base material by a known coating method such as bar coating, or immersing the non-conductive base material in the coating solution, and drying the solution. The curable layer and the catalyst adhering layer do not need to be formed over the whole surface of the non-conductive base material, and it may be formed over a part of it. By providing the curable layer and the catalyst adhering layer over a part of the non-conductive base material, the catalyst can be selectively adhered to the part of the non-conductive base material, and thus the electroless plating and electrolytic plating can be selectively performed on that part.

In the material for forming electroless plate of the above present invention described above, the catalyst adhering layer is formed from a hydrophilic and/or water-soluble resin having hydroxyl group, and a curable layer formed from a resin having hydroxyl group and an isocyanate type compound is provided between the non-conductive base material and the catalyst adhering layer. Therefore, adhesion between the non-conductive base material and the catalyst adhering layer, solvent resistance of the curable layer, and solvent resistance of the catalyst adhering layer can be improved by reactions of the isocyanate type compound and the resin having hydroxyl group in the curable layer, and the isocyanate type compound in the curable layer and the hydrophilic and/or water-soluble resin having hydroxyl group in the catalyst adhering layer. Delamination of the curable layer and the catalyst adhering layer from the non-conductive base material can be thereby prevented. Moreover, since such effect can be obtained without unduly curing the catalyst adhering layer, the catalyst adhesion performance of the catalyst adhering layer is not degraded. That is, a material for forming electroless plate having a catalyst adhering layer, which shows superior catalyst adhesion performance because of hydrophilicity thereof, and also shows superior adhesion to a base material and superior solvent resistance, can be obtained.

The method for forming an electroless plate of the present invention will be explained below. The method for forming an electroless plate of the present invention comprises making a catalyst adhere to the catalyst adhering layer of the material for forming electroless plate of the present invention, and then performing electroless plating. Embodiments of the method for forming an electroless plate of the present invention will be explained below.

First, a catalyst is adhered to the catalyst adhering layer of the material for forming electroless plate of the present invention described above.

As the fine metal particles having a catalytic activity for electroless plating (catalyst), those of gold, silver, ruthenium, rhodium, palladium, tin, iridium, osmium, platinum and so forth and mixtures thereof can be used. The catalyst is preferably used as a colloidal solution. A method generally used for preparation of a colloidal solution of the catalyst is dissolving a water-soluble salt containing the catalyst in water, adding a surfactant to the solution, and adding a reducing agent to the mixture with vigorous stirring. However, other known methods may also be used.

Examples of the method for making the catalyst adhere to the catalyst adhering layer of the material for forming electroless plate include a method of successively performing a sensitization treatment (sensitizing) and an activation treatment (activating) by using a colloidal solution of the catalyst, and a method of successively performing catalyzing and accelerating. Since the material for forming electroless plate provided with the catalyst adhering layer showing superior catalyst adhesion performance is used in the present invention, the catalyst adhesion step can be completed in an extremely short period of time, and thereby dissolution of the catalyst adhering layer into the catalyst dispersion can be prevented.

In addition, it is preferable to subject the material for forming electroless plate to a degreasing treatment performed by washing with an acid and/or alkali before the catalyst is adhered to the catalyst adhering layer. Since the material for forming electroless plate provided with the hydrophilic catalyst adhering layer is used in the present invention, the degreasing treatment can also be completed in an extremely short period of time.

Moreover, in addition to the degreasing treatment, conditioning and pre-dipping steps are generally performed for improving wetting property of the catalyst adhering layer before a catalyst is adhered to the catalyst adhering layer. However, those steps may be omitted in the present invention because the material for forming electroless plate provided with the catalyst adhering layer showing superior wetting property is used.

After the catalyst is adhered to the catalyst adhering layer, electroless plating is performed. The electroless plating can be performed by, for example, immersing the material for forming electroless plate, on which the catalyst is adhered, in an electroless plating bath containing a water-soluble compound of a metal to be plated (usually metal salt), a complexing agent, a pH adjustor, a reducing agent and a plating aid. By adjusting various conditions such as bath composition, temperature, pH and immersion time, thickness of the electroless plate can be controlled.

Examples of the metal to be plated by the electroless plating include non-electrolytic copper, non-electrolytic nickel, non-electrolytic copper/nickel/phosphorus alloy, non-electrolytic nickel/phosphorus alloy, non-electrolytic nickel/boron alloy, non-electrolytic cobalt/phosphorus alloy, non-electrolytic gold, non-electrolytic silver, non-electrolytic palladium, non-electrolytic tin and so forth.

As the complexing agent, pH adjustor, plating aid and reducing agent, those conventionally known as these can be used.

After an electroless plate is formed, electrolytic plating is performed as required. The electrolytic plating can be performed by immersing the material for forming electroless plate on which electroless plate is formed in a known electrolytic plating bath and electrifying it. By adjusting current density and electrification time, thickness of the electrolytic plate can be controlled.

After the electrolytic plate is formed, pattern formation may be performed as required. The pattern formation can be performed by, for example, applying a photoresist to the electrolytic plate, performing exposure and removing the photoresist of exposed or unexposed portions with a developer together with the electrolytic plate, the electroless plate, the catalyst adhering layer and the curable layer.

The material for forming electroless plate on which electroless plate or electroless plate and electrolytic plate are formed as described above can be used for a printed wiring board, an electromagnetic wave shielding member, a sheet type heating element, an antistatic sheet, an antenna, and so forth.

EXAMPLES

Hereafter, the present invention will be further explained with reference to examples. The term "part" and the symbol "%" are used on the weight basis, unless specifically indicated.

Examples

1. Preparation of Coating Solution for Curable Layer

As the resin having hydroxyl group, polyester resins a to c having different hydroxyl values were prepared, and each polyester resin was dissolved according to the following composition to obtain 10% polyester resin solutions a to c.

Polyester resin a (Vylon 200, Toyobo Co., Ltd., solid content: 100%, hydroxyl value: 3 mg KOH/g)

Polyester resin b (Elitel UE3690, Unitika, Ltd., solid content: 100%, hydroxyl value: 8 mg KOH/g)

Polyester resin c (Elitel UE3350, Unitika, Ltd., solid content: 100%, hydroxyl value: 25 mg KOH/g)

<10% Polyester Resin Solutions a to c>

| | |
|---|---|
| One of Polyester resin a to c | 10 parts |
| Methyl ethyl ketone | 40 parts |
| Toluene | 40 parts |
| Cyclohexanone | 10 parts |

Then, the 10% polyester resin solutions a to c and an isocyanate type compound (Takenate D160N, Mitsui Chemicals Polyurethane Inc., solid content: 75%, NCO %: 12.6%) were mixed at molar ratios of hydroxyl groups and isocyanate groups of 1:1.3, 1:2.5, 1:5 and 1:7.5 according to the weight percentages shown in Table 1 to obtain the coating solutions for curable layer A to L.

TABLE 1

| | 10% Polyester resin solution a | 10% Polyester resin solution b | 10% Polyester resin solution c | Iso-cyanate com-pound | Hydroxyl group:isocyanate group |
|---|---|---|---|---|---|
| Coating solution for curable layer A | 16.83 | — | — | 0.05 | 1:1.3 |
| Coating solution for curable layer B | 16.83 | — | — | 0.10 | 1:2.5 |
| Coating solution for curable layer C | 16.83 | — | — | 0.20 | 1:5.0 |
| Coating solution for curable layer D | 16.83 | — | — | 0.30 | 1:7.5 |
| Coating solution for curable layer E | — | 18.93 | — | 0.15 | 1:1.3 |
| Coating solution for curable layer F | — | 18.93 | — | 0.30 | 1:2.5 |
| Coating solution for curable layer G | — | 18.93 | — | 0.60 | 1:5.0 |
| Coating solution for curable layer H | — | 18.93 | — | 0.90 | 1:7.5 |
| Coating solution for curable layer I | — | — | 20.20 | 0.50 | 1:1.3 |
| Coating solution for curable layer J | — | — | 20.20 | 1.00 | 1:2.5 |
| Coating solution for curable layer K | — | — | 20.20 | 2.00 | 1:5.0 |
| Coating solution for curable layer L | — | — | 20.20 | 3.00 | 1:7.5 |

2. Preparation of Materials for Forming Electroless Plate of Examples 1 to 12

(Preparation of Material for Forming Electroless Plate of Example 1)

On one surface of a polyester film having a thickness of 100 μm (Lumirror T60, Toray Industries, Inc.), the coating solution for curable layer A was applied and dried at 100° C. for 30 seconds to form a curable layer having a thickness of 1 μm. After formation of the curable layer, a coating solution for catalyst adhering layer M having the following composition was immediately applied on the curable layer and dried at 110° C. for 5 minutes to form a catalyst adhering layer having a thickness of 1.5 μm and thereby obtain a material for forming electroless plate of Example 1.

<Coating Solution for Catalyst Adhering Layer M>

| | |
|---|---|
| Polyvinyl alcohol (Gohsenol NH20, Nippon Synthetic Chemical Industry Co., Ltd.) | 1 part |
| Water | 9 parts |

(Preparation of Materials for Forming Electroless Plate of Examples 2 to 12)

The materials for forming electroless plate of Examples 2 to 12 were obtained in the same manner as that of Example 1 except that the coating solution for curable layer A was changed to the coating solutions for curable layer B to L, respectively.

Comparative Examples

Preparation of Material for Forming Electroless Plate of Comparative Example 1

A material for forming electroless plate of Comparative Example 1 was obtained in the same manner as that of Example 1 except that the catalyst adhering layer was formed directly on the polyester film without forming curable layer.

(Preparation of Material for Forming Electroless Plate of Comparative Example 2)

On one surface of a polyester film having a thickness of 100 μm (Lumirror T60, Toray Industries, Inc.), a coating solution for catalyst adhering layer N having the following composition was applied and dried at 130° C. for 15 minutes to form a catalyst adhering layer having a thickness of 1.5 μm and thereby obtain a material for forming electroless plate of Comparative Example 2.

<Coating Solution for Catalyst Adhering Layer N>

| | |
|---|---|
| Polyvinyl alcohol (Gohsenol NH20, Nippon Synthetic Chemical Industry Co., Ltd.) | 1 part |
| Blocked isocyanate compound (Takelac WB700, Mitsui Chemicals Polyurethane Inc., dissociation temperature: 120° C.) | 0.5 part |
| Water | 9 parts |

Reference Example

Preparation of Material for Forming Electroless Plate of Reference Example

A material for forming electroless plate of Reference Example was obtained in the same manner as that of Example 1 except that the polyester film on which the curable layer was formed was subjected to a heat treatment at 60° C. for 24 hours so that isocyanate groups in the curable layer should completely react, before the catalyst adhering layer was formed.

The following steps (1) to (4) were performed for the materials for forming electroless plate of Examples 1 to 12, Comparative Examples 1 and 2 and Reference Example to form an electroless plate and an electrolytic plate on each material for forming electroless plate.

(1) Degreasing Treatment

A degreasing treatment was performed for 60 seconds by using an aqueous alkaline solution (30 g/L NaOH aqueous solution).

(2) Catalyst Adhesion

Sensitization and activation were successively performed for 60 seconds and 30 seconds, respectively, by using a mixed colloidal solution of palladium and tin (0.1 g/L of palladium chloride, 8 g/L of tin chloride) as a catalyst bath.

(3) Electroless Plating

Electroless plating was performed by using an electroless plating bath having the following composition under the conditions of a bath temperature of 60° C. and an immersion time of 15 minutes.

<Electroless Plating Bath>

| | |
|---|---|
| Copper sulfate pentahydrate | 0.03 M |
| EDTA tetrahydrate | 0.24 M |
| Formalin | 0.20 M |
| Dipyridyl | 10 ppm |
| Surfactant | 100 ppm |

(4) Electrolytic Plating

Electrolytic plating was performed by using a copper sulfate plating bath (CU-BRITE TH Process, Ebara Udylite Co., Ltd.) as an electrolytic plating bath until the plate thickness became about 30 μm.

The materials for forming electroless plate of Examples 1 to 12, Comparative Examples 1 and 2 and Reference Example on which electroless plate and electrolytic plate were formed were evaluated for the following items. The results are shown in Table 2.

(1) Uniformity of Plate

Whether the plate was uniformly formed or not was evaluated by visual inspection. Plate uniformly formed without unevenness is indicated with "○", and plate not uniformly formed with unevenness is indicated with "X".

(2) Adhesion

Each plated surface was cut so that 100 grids should be formed with 1 mm-gaps between them, cellophane adhesive tape was stuck on a cut part of the surface and removed, and then area ratio of layers (electrolytic plate, electroless plate, catalyst adhering layer, curable layer) still adhering to the non-conductive base material was evaluated by visual inspection.

(3) Solvent Resistance

Photoresist was applied on each electrolytic plate, a photomask was disposed on the photoresist, and the photoresist was exposed and developed to form a circuit pattern. The material for forming electroless plate on which the circuit pattern was formed was immersed in an ethyl acetate bath for 5 minutes and pulled up, and conditions of the layers (electrolytic plate, electroless plate, catalyst adhering layer, curable layer) were evaluated by visual inspection. The result of no delamination of the layers is indicated with the symbol "○", and the result of separation (delamination) of the layers from the non-conductive base material is indicated with the symbol "X".

TABLE 2

| | Uniformity | Adhesion | Solvent resistance |
|---|---|---|---|
| Example 1 | ○ | 100% | ○ |
| Example 2 | ○ | 100% | ○ |
| Example 3 | ○ | 100% | ○ |
| Example 4 | ○ | 100% | ○ |
| Example 5 | ○ | 100% | ○ |
| Example 6 | ○ | 100% | ○ |
| Example 7 | ○ | 100% | ○ |
| Example 8 | ○ | 100% | ○ |
| Example 9 | ○ | 100% | ○ |
| Example 10 | ○ | 100% | ○ |
| Example 11 | ○ | 100% | ○ |
| Example 12 | ○ | 100% | ○ |
| Comparative Example 1 | ○ | 0% | X |
| Comparative Example 2 | X | 0% | ○ |
| Reference Example | ○ | 0% | X |

As clearly seen from the results shown above, since the materials for forming electroless plate of Examples 1 to 12 had the catalyst adhering layer formed from a hydrophilic and/or water-soluble resin containing hydroxyl group, and a curable layer formed from a resin having hydroxyl group and an isocyanate type compound between the base material (polyester film) and the catalyst adhering layer, besides plate could of course be uniformly formed on them, plates could be firmly adhered to them, and they showed superior solvent resistance. Moreover, according to the method for forming an electroless plate used in Examples 1 to 12, electroless plates could be easily formed on the non-conductive base materials, and the curable layers and the catalyst adhering layers on the non-conductive base materials did not delaminate during the operation.

In the material for forming electroless plate of Comparative Example 1, curable layer was not formed, and the catalyst adhering layer was formed directly on the base material. Therefore, the material showed poor adhesion and solvent resistance.

In the material for forming electroless plate of Comparative Example 2, the catalyst adhering layer was cured. However, since it did not have the curable layer, it showed poor adhesion. Moreover, since the catalyst adhering layer was fully cured before adhesion of the catalyst in this material, the catalyst could not be sufficiently adhered, and the formed plate showed unevenness and was not uniform.

In the material for forming electroless plate of Reference Example, isocyanate groups in the curable layer were completely reacted before formation of the catalyst adhering layer, and therefore reactions between the isocyanate groups in the curable layer and the hydroxyl groups in the catalyst adhering layer could not occur. Thus, this material showed inferior adhesion and solvent resistance compared with those of the materials of Examples 1 to 12.

The invention claimed is:

1. A material for electroless plating, comprising:

a non-conductive base material;

a catalyst adhering layer provided on the non-conductive base material, wherein the catalyst adhering layer is formed from a hydrophilic and/or water-soluble resin containing hydroxyl group; and a curable layer formed from a resin having hydroxyl group and having a hydroxyl value of 1 to 30 mgKOH/g and an isocyanate compound is provided between the base material and the catalyst adhering layer; and catalytic metal particles adhered to the catalyst adhering layer.

2. The material for electroless plating according to claim 1, wherein the catalyst adhering layer is formed while isocyanate groups of the isocyanate compound in the curable layer remain.

3. The material for electroless plating according to claim 1, wherein the catalyst adhering layer contains a blocked isocyanate compound masked with a masking agent.

4. The material for electroless plating according to claim 1, wherein the curable layer has a thickness of 2 μm or less.

5. The material for electroless plating according to claim 1 wherein the metal particles are selected from the group consisting of gold, silver, ruthenium, rhodium; palladium, tin, iridium, osmium, platinum and mixtures thereof.

* * * * *